United States Patent [19]

Hasle

[11] 4,378,179

[45] Mar. 29, 1983

[54] COMPLIANT PILE SYSTEM FOR SUPPORTING A GUYED TOWER

[75] Inventor: Alf E. Hasle, Slependen, Norway

[73] Assignee: Exxon Production Research Co., Houston, Tex.

[21] Appl. No.: 277,494

[22] Filed: Jun. 26, 1981

[51] Int. Cl.[3] ..... E02B 17/00

[52] U.S. Cl. ..... 405/227; 405/224

[58] Field of Search ..... 405/195, 197, 202, 224, 405/225, 227, 228

[56] References Cited

U.S. PATENT DOCUMENTS

| | | | |
|---|---|---|---|
| 996,397 | 6/1911 | Breuchaud . | |
| 3,307,624 | 3/1967 | Lubinski . | |
| 3,347,053 | 10/1967 | Manning | 405/227 X |
| 3,512,811 | 5/1970 | Bardgette et al. . | |
| 3,543,523 | 12/1970 | Nelson . | |
| 3,550,384 | 12/1970 | Bardgette et al. . | |
| 4,070,867 | 1/1978 | Cassidy . | |
| 4,181,454 | 1/1980 | Knox et al. | 405/227 |
| 4,273,474 | 6/1981 | Weidler | 405/225 |

OTHER PUBLICATIONS

"A New Deepwater Offshore Platform—The Guyed Tower", by L. D. Finn, OTC Paper No. 2688, presented at the Offshore Technology Conference, Houston, Texas, May 3-6, 1976.

"The Guyed Tower as a Platform for Integrated Drilling and Production Operations", by L. D. Finn, et al., *Journal of Petroleum Technology*, Dec. 1979, pp. 1531-1537.

"A Guyed Tower for North Sea Production", L. D. Finn, et al., Paper T-11/5, presented at the Offshore North Sea Technology Conference and Exhibition, Stavanger, Norway, Aug. 26-29, 1980.

"Design Criteria of a Pile Founded Guyed Tower", by A. Mangiavacchi, et al., OTC Paper No. 3882, presented at the Offshore Technology Conference, Houston, Texas, May 5-8, 1980.

"Evaluation of Concepts for Guyed Tower Foundations", by H. Hudson, et al., OTC Paper No. 4147, presented at the Offshore Technology Conference, Houston, Texas, May 4-7, 1981.

*Primary Examiner*—David H. Corbin

*Attorney, Agent, or Firm*—M. L. Delflache; K. A. Bell

[57] ABSTRACT

A compliant pile system for supporting the vertical weight of a guyed tower structure installed in a body of water. The pile system is comprised of at least one pile element which in turn is comprised of a pile jacket and a pile member. The pile jacket extends from one point in the structure to a second point which lies above the first point and is attached at only one point to the structure. The pile member passes through the pile jacket and is forced into the marine bottom and is attached only at its upper end to the pile jacket. In one modification, the pile jacket is comprised of an odd number of concentrically positioned sleeves with the pile member being affixed to the top of the innermost sleeve and the outermost sleeve being affixed only at its bottom to the structure. The sleeves, if more than one, are attached to each other at their respective alternate ends. In another modification, the pile jacket is comprised of an even number of concentrically positioned sleeves with the pile member being affixed only at its upper end to the innermost sleeve and the outermost sleeve being affixed only at its upper end to the structure. The sleeves themselves are connected together only at alternating respective ends thereof. By constructing and affixing the pile jacket as described and affixing the pile member thereto only at its upper end, the effective length of the pile element is increased and its axial stiffness is reduced.

14 Claims, 5 Drawing Figures

FIG.1A
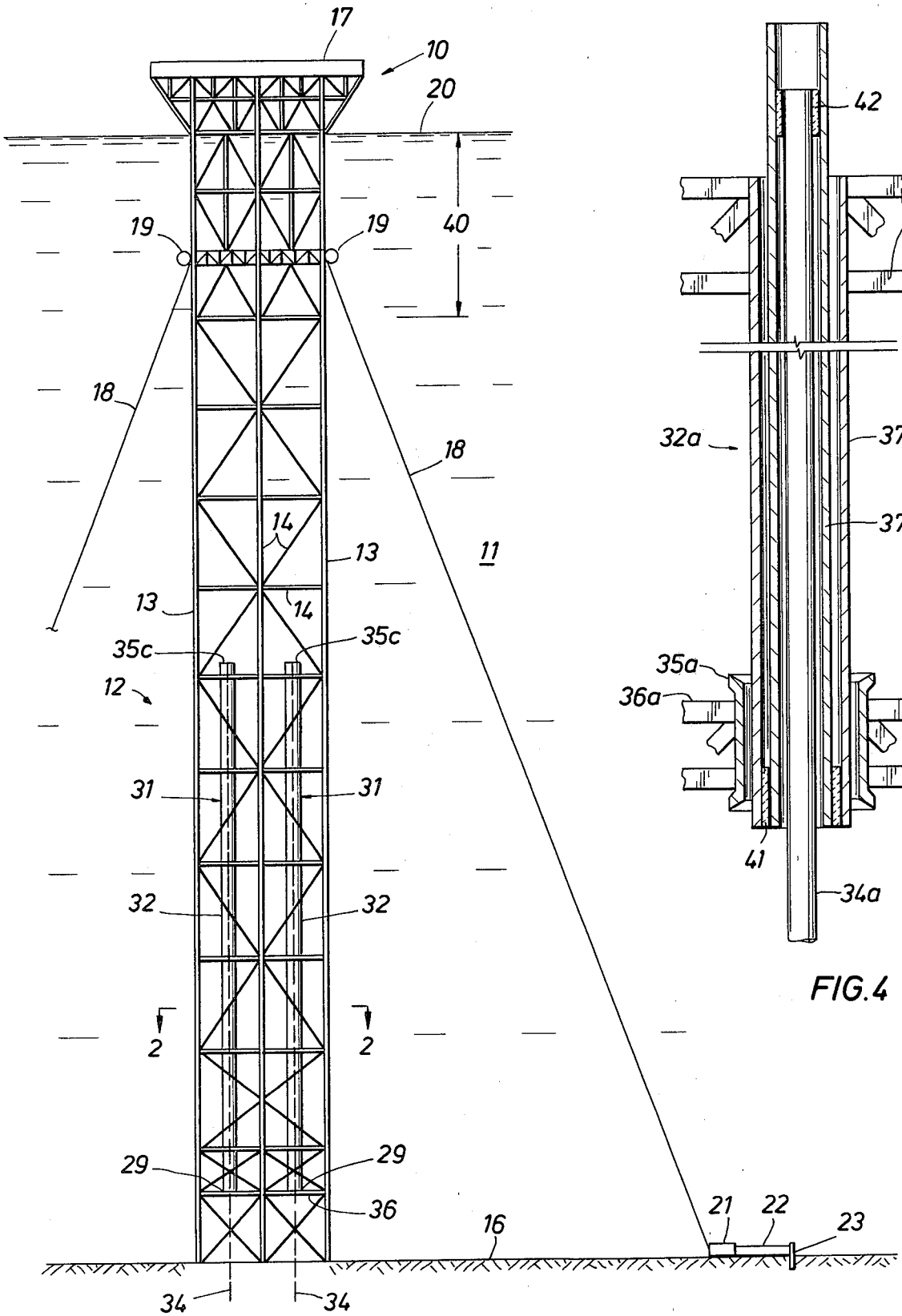
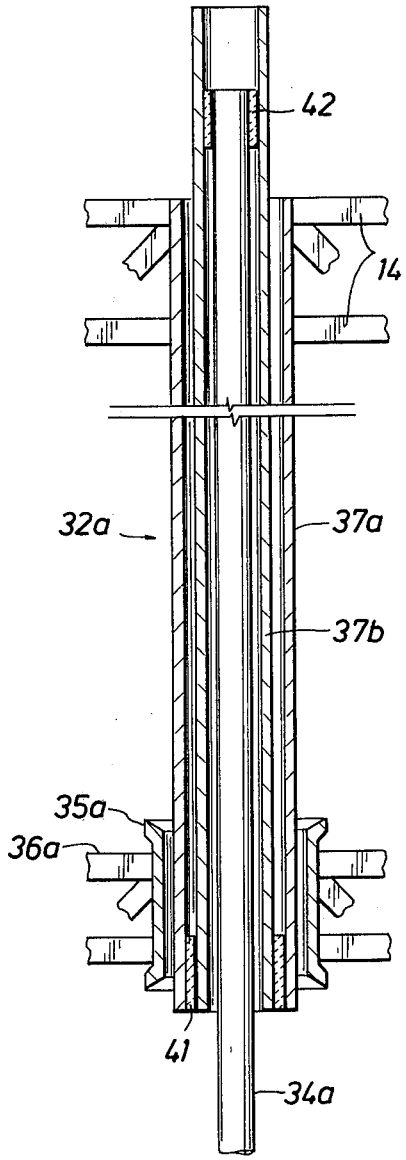
FIG.4

COMPLIANT PILE SYSTEM FOR SUPPORTING A GUYED TOWER

BACKGROUND OF THE INVENTION

The present invention relates to a pile system for securing an offshore structure and, more particularly, relates to a compliant pile system for securing a guyed tower offshore platform and supporting the net vertical weight thereof when said guyed tower is installed in a body of water.

New offshore structures recently have been proposed for recovering hydrocarbons from marine deposits which underlie great depths of water. One such offshore structure is a compliant platform known in the art as a "guyed tower" platform. Basically, a guyed tower is a trussed structure of uniform cross-section that rests on the marine bottom and extends upward to a deck supported above the surface. The structure is held upright by multiple guylines which are spaced about the trussed structure. The structure is "compliant", e.g. tilts, in response to surface wave or wind forces, thereby creating inertial forces which counteract the applied forces. These counteracting forces aid in reducing total forces transmitted to the platform's restraints.

While various geometric cross-sections may be used, the main truss of a typical guyed tower structure normally has four, equally-spaced legs connected together with conventional triangularly-arranged bracing members.

Previously proposed guyed towers have relied upon either a truss-reinforced shell foundation, called a "spud can", or piles to secure the structure in position and, more importantly, to carry the net vertical weight of the structure. The spud can provides a pivot point for the tilting of the structure. Since the structure rests directly on the marine bottom, the spud can serves primarily to transmit the axial load to the marine bottom in bearing capacity. Piles, on the other hand, extend from the connection of the pile to the platform (referred to as the "pile-platform" connection) through pile guides spaced along the length of the structure into the marine bottom. Piles support the structure by transmitting axial load as well as shear loads into the marine bottom.

Pile systems normally require multiple pile members which, due to available space, necessitates the placement of some or all of the main piles eccentric to the axis of tilt of the structure. Due to this eccentricity, the sway or tilting motions of the compliant guyed tower structure impose deflections at the pile-platform connection (referred to as "pile-head" deflections) that result in substantial increases in the axial forces applied to the piles. When the axial forces due to the pile-head deflections are added to the axial loads in the piles due to the weight of the structure, deck, etc., the total axial loads imposed on the piles may become excessive.

Further, since these piles may extend from the marine bottom to the surface, they may pass through the "wave zone." This is the zone of water at and below the surface which is affected by the presence of surface waves. Each of the piles presents a drag surface against which the waves act, thereby increasing the overturning forces applied to the guyed tower. Accordingly, it may be desirable to reduce both the axial loads on the piles and the drag surfaces exposed in the wave zone.

SUMMARY OF THE INVENTION

The present invention involves a pile system for a guyed tower structure which decreases the contribution to the axial loads in each of the pile members due to pile-head deflections without seriously affecting the compliancy of the guyed tower, itself.

Structurally, the present compliant pile system is comprised of at least one pile element which, in turn, is comprised of two structural components, i.e. a pile member and a surrounding pile jacket.

In a first embodiment of the present invention, the pile jacket is comprised of 1, 3, or other odd numbers of concentrically positioned sleeves. The pile jacket extends from a first point on the main truss of the guyed tower to a second point on the main truss which lies above the first point. The pile jacket has its outermost sleeve affixed to the main truss at only the first point; that is, only the lower end of the outermost sleeve is affixed to the main truss. The pile jacket is free to move axially with respect to spaced guides which are affixed at predetermined locations along the main truss. The pile member is positioned through the pile jacket and is forced downward to a point within the marine bottom. The pile member terminates adjacent the second point or upper end of the pile jacket and is affixed only to the innermost sleeve of the pile jacket at the upper end thereof. If an odd number of sleeves other than one comprise the pile jacket, the sleeves are affixed to each other alternately at their upper and lower ends respectively as will be described in detail below.

In another embodiment of the present invention, the pile jacket is comprised of 2, 4, or other even number of concentrically mounted sleeves. Again, the pile jacket extends from a first point on the main truss to a second point on the main truss which lies above the first point. The pile jacket has its outermost sleeve affixed to the main truss at only the second point; that is, only the upper end of the outermost sleeve is affixed to the main truss. The pile jacket is free to move axially with respect to spaced guides which are affixed at predetermined locations along the main truss. The pile member, which is positioned through the pile jacket and is forced into the marine bottom, is affixed only to the upper end of the innermost sleeve of the pile jacket at the upper end thereof. The concentric sleeves comprising the pile jacket are affixed to each other alternately at their upper and lower ends respectively as will be described in detail below.

By forming each pile element as described, it can be seen that the present pile system supports the vertical weight of the guyed tower structure while at the same time reducing the contribution to the axial loads applied to an individual pile element due to pile-head deflections. A reduction in the axial load also requires less pile penetration into the marine bottom and also reduces the cyclic stress levels in the pile thereby reducing its susceptibility to fatigue problems. In addition, the present invention permits the placement of the pile jacket out of the "wave zone" thereby substantially reducing the wave and current loads on the structure.

BRIEF DESCRIPTION OF THE DRAWINGS

The actual operation and the apparent advantages of the invention will be better understood by referring to the drawings in which like numerals identify like parts and in which:

FIG. 1A is an elevation view of an installed guyed tower structure incorporating the present invention;

FIG. 4 is a partial, sectional view of the other embodiment of the present invention.

DETAILED DESCRIPTION OF THE INVENTION

Figure 1B:
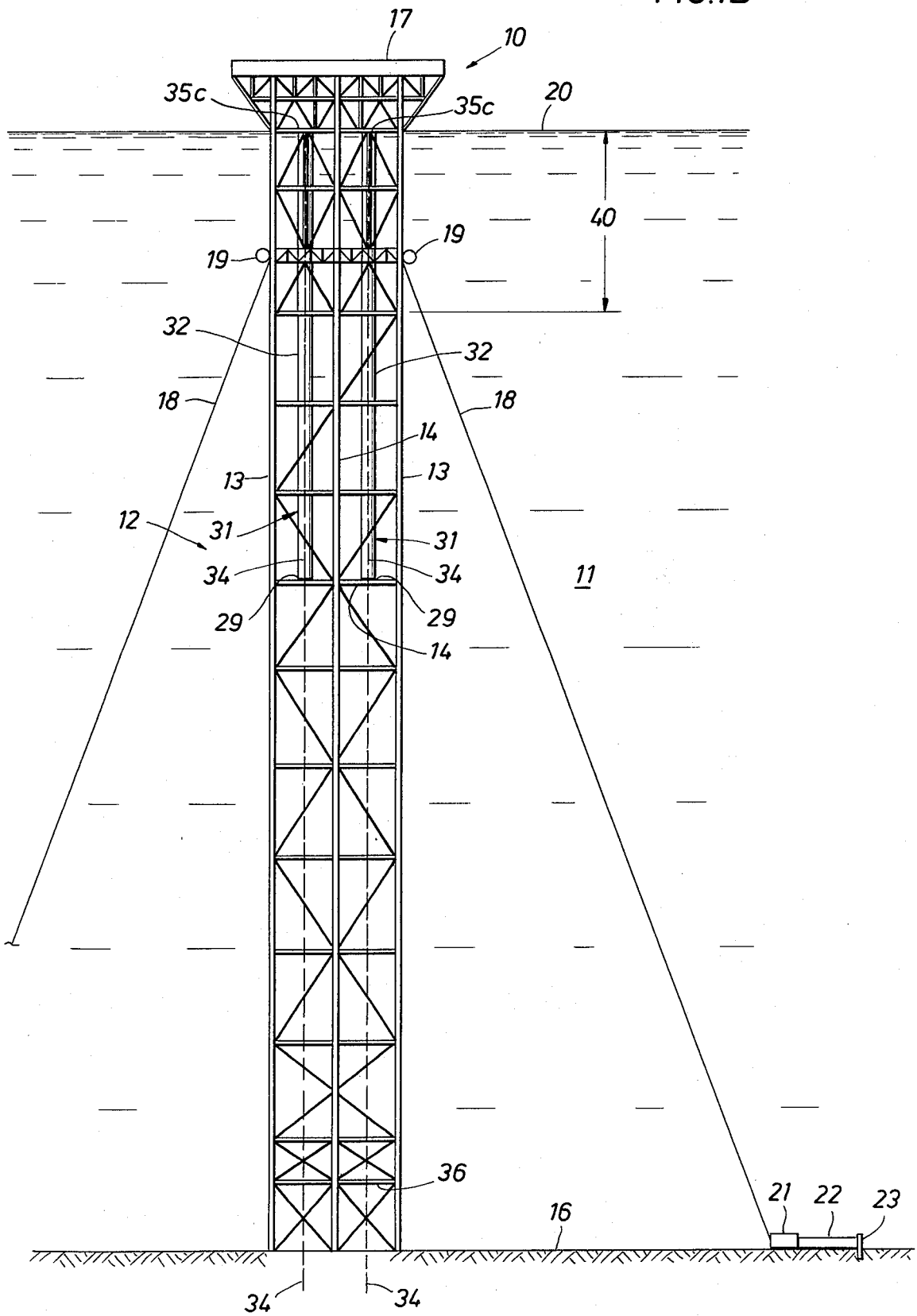
FIG. 1B is another elevation view of an installed guyed tower structure incorporating the present invention.
Figure 2:
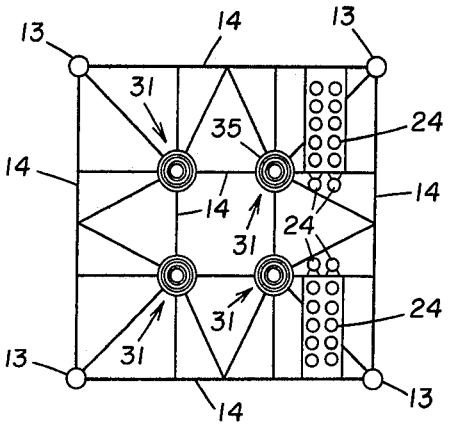
FIG. 2 is a sectional view taken along line 2—2 of FIG. 1A.

Referring more particularly to the drawings, FIGS. 1A and 1B disclose a guyed tower structure 10 installed in a body of water 11. As illustrated, guyed tower 10 is comprised of a main truss section 12 having four equally spaced legs 13 (FIG. 2) connected by conventional brace members 14.

Deck 17 is mounted on the upper end of truss 12 and is used in carrying out drilling and production operations from guyed tower structure 10. A plurality of guylines 18 (e.g. 24 guylines although only 2 are shown) are symmetrically spaced about truss 12. Each guyline 18 is secured at deck 17 by cable grips (not shown) and passes downward within truss 12 and around a fairhead 19 on truss 12 which in turn is located below surface 20 of water body 11. Each guyline 18 then travels outward from truss 12 at an angle (e.g. 30°-60° from the vertical) to articulated clump weights 21 on marine bottom 16. Horizontal anchor lines 22 are used to connect clump weights 21 to anchor piles 23 or the like. Guylines 18 serve to keep truss 12 in a vertical position and act to restore truss 12 to a vertical position whenever the truss is tilted by wind, wave or current actions. A plurality (e.g. 24) of well conductors 24 (shown only in FIG. 2) are provided through truss 12 and, as will be understood by those skilled in the art, extend from deck 17 and into marine bottom 16, through which wells may be drilled and completed.

The structure described to this point is that of a known, typical guyed tower structure. For a more complete description of the structure and the operational characteristics of such a guyed tower, reference is made to the following papers: (1) "A New Deepwater Offshore Platform—The Guyed Tower", L. D. Finn, Paper Number OTC 2688, presented at the Offshore Technology Conference, Houston, Texas, May 3-6, 1976, and (2) "A Guyed Tower for North Sea Production", L. D. Finn and G. G. Thomas, Paper T-11/5, presented at Offshore North Sea Technology Conference and Exhibition, Stavanger, Norway, Aug. 26-29, 1980, both of which are incorporated herein by reference.

In accordance with the present invention, a compliant pile system 30 (FIG. 3) is provided for supporting the vertical weight of tower 10. It should be recognized that for the sake of clarity in the figures, system 30 and its various components are not necessarily shown to scale in relation to the other structure of tower 10 but may be slightly exaggerated to better illustrate the details of the present invention.

System 30 is comprised of a plurality of pile elements 31. Although, for clarity, only four pile elements 31 are shown (FIG. 2), it should be understood that the exact number of pile elements may vary with the parameters involved in the actual application of tower 10, i.e. water depth, expected wave, wind and current conditions, soil conditions, size of tower 10, etc. Each pile element 31 is comprised of two components, i.e. a pile jacket and a pile member.

In the embodiment shown in FIGS. 1A-3, pile element 31 is comprised of pile jacket 32 having pile member 34 (shown in heavy dotted lines in FIG. 1) located therein. Pile jacket 32 is comprised of an odd number (1 as shown) of concentric sleeves 37 (FIG. 3) and is positioned through aligned pile guides 35. The guides 35 are affixed to the brace members 14 of truss 12. Each pile jacket 32 extends from a first point 29 on truss 12 to a second point **35*c* (FIGS. 1A and 1B) on truss 12**.

In FIG. 1A the pile jacket is shown extending from a first point 29 at or near the lower end of truss 12 to a second point **35*c* which lies below wave zone 40 (FIG. 1B). Wave zone 40 is the water zone below the surface 20** which is affected by surface wave conditions. This is the preferred location for the pile jacket since it is removed from the wave zone, and thus the forces associated with surface waves are minimized.

As shown in FIG. 1B, the pile jacket may be located at the upper end of the truss 12. Indeed, the pile jacket may be located at any location along the length of the truss. The exact place that pile jacket 32 is located on truss 12 will be determined by the actual conditions involved in each particular application of tower 10. In any event, if pile jacket 32 comprises an odd number of concentric sleeves 37, the outermost sleeve is affixed to truss 12 only at the first point 29 and, thus, is free to move axially with respect to pile guides 35 on truss 12. Pile member 34 passes through pile jacket 32 and is driven or otherwise forced into marine bottom 16 to a predetermined depth during installation of tower 10. Pile member 34 is then affixed only at its upper end 38 to the upper end of sleeve 37 by welding or the like.

By forming each pile element 31 with a pile member 34 and a pile jacket 32 and joining the two as described above, pile element 31 acts as a single pile of continuous length. In other words, by doubling the pile back along its own length, the effective length of the pile is increased and the axial stiffness of the pile element is substantially reduced. This reduction in axial stiffness not only reduces the additional axial loads imposed on each pile element 31 due to any sway motion of tower 10 but also reduces the resistance to these sway motions. In addition, if pile elements 31 terminate below wave zone 40 as shown in FIG. 1A, the number of structural members exposed to current and wave forces in this zone is reduced thereby reducing the horizontal load applied to the structure.

Figure 3:
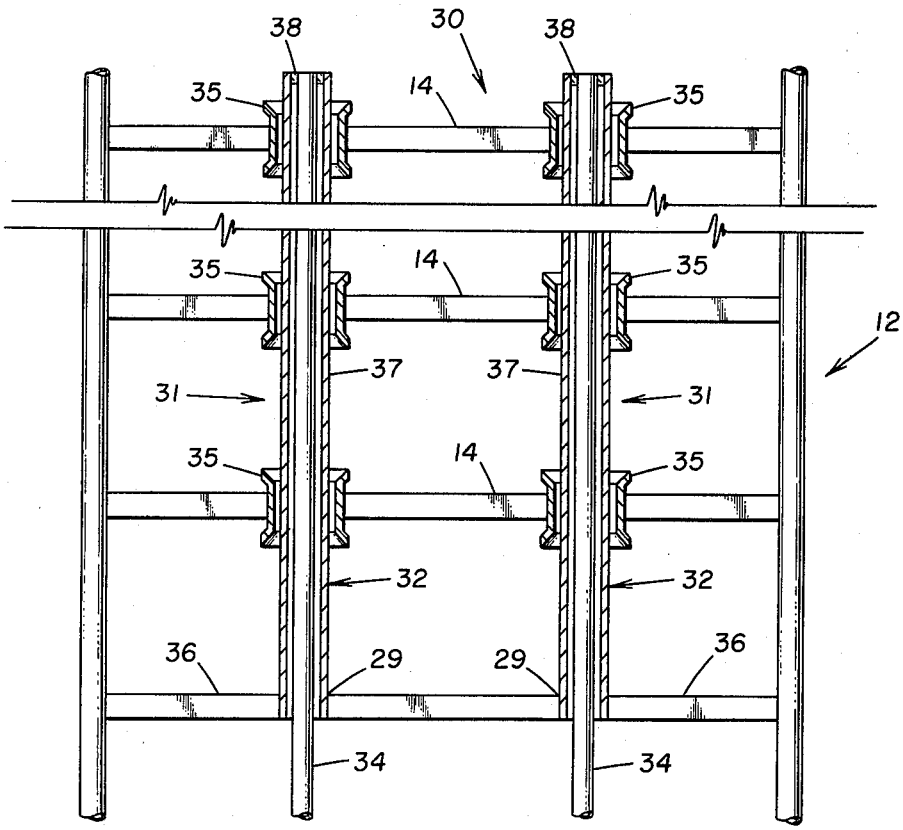
FIG. 3 is an elevation view, partly in section, of a first embodiment of the present invention.

Another embodiment of the present invention is shown in FIG. 4 wherein pile jacket **32*a* is comprised of an even number (two shown) of concentric sleeves 37*a*, 37*b*, as opposed to an odd number of sleeves as described above. Inner sleeve 37*b* is located within outer sleeve 37*a* with only their lower ends being joined together by welding 41 or the like, as shown in FIG. 4. Pile jacket 32*a* passes through pile guide 35*a*, which is affixed to truss brace member 36*a* of truss 12, and through other aligned pile guides 35 (as generally shown in FIG. 3) spaced along truss 12. If an even number of sleeves are used, the pile jacket 32*a* is affixed only at one point to truss 12, that being at its upper end or at the second point 35*c* to truss 12** by welding or the like. Preferably, this second point is below the wave zone to reduce horizontal forces.

Pile 34a passes through inner sleeve 37b of pile jacket 32a and is forced into marine bottom 16, similar to pile 34 as discussed in the previous embodiment. Pile 34a is affixed only at its upper end to the upper end of inner sleeve 37b by welding 42 or the like. By interconnecting the sleeves at alternating ends as described, the effective length of the pile element is increased while its axial stiffness is reduced.

It should be recognized that more than two sleeves may be used to form a pile jacket in accordance with the present invention. That is, in the first embodiment, an odd number (e.g. 3) of sleeves may be used wherein the pile member is affixed at its upper end to the top of the innermost sleeve. The lower end of the innermost sleeve is attached to the lower end of an intermediate sleeve. The upper end of the intermediate sleeve is attached to the upper end of an outer sleeve, and the lower end of the outer sleeve is affixed to the lower end of the truss 12. Likewise, in the other embodiment, an even number (e.g. 4) of sleeves, more than two, may be used to form the pile jacket. Again, the pile member is affixed at its upper end to the upper end of the innermost sleeve and the sleeves are connected alternately at their respective ends, with the upper end of the outermost sleeve being affixed to the truss 12.

It also should be recognized that all the sleeves do not have to be the same length. It is only necessary that a connection be made between alternating ends of adjacent sleeves which permits the appropriate reduction in the axial stiffness of the pile. In other words, the connection need only be made at the proximate ends of the sleeves. One or more sleeves may extend beyond the connection as shown in FIG. 4.

It should also be understood that the invention may be used on an offshore structure which does not extend above the water surface (e.g. a submerged structure having a pile system to anchor the structure to the marine bottom).

The present invention has been described in terms of a preferred embodiment. Modifications and alterations to this embodiment will be apparent to those skilled in the art in view of this disclosure. It is therefore intended that all such equivalent modifications and variations fall within the spirit and scope of the present invention as claimed.

What is claimed is:

1. A compliant pile system for supporting the vertical weight of an offshore structure of the type which extends between the marine bottom and the surface of a body of water, said system comprising:

at least one element comprising:

a pile jacket, having an upper and lower end, extending from a first point on said offshore structure to a second point on said structure, said second point being above said first point, and said pile jacket being affixed to said offshore structure at only one point; and a pile member, having an upper and lower end, positioned within said marine bottom, said pile member being affixed to the proximate upper end of said pile jacket at only the upper end of said pile member.

2. The compliant pile system of claim 1 wherein said second point lies below the wave zone of said body of water.

3. The compliant pile system of claim 1 wherein said pile jacket comprises:

a sleeve, having an upper and lower end, and affixed only at its proximate lower end to said offshore structure at said first point.

4. The compliant pile system of claim 1 wherein said pile jacket comprises:

an inner sleeve, having an upper and lower end, concentrically positioned around said pile member and affixed at its proximate upper end to said upper end of said pile member; and an outer sleeve, having an upper and lower end, concentrically positioned around said inner sleeve, said outer sleeve having its proximate lower end affixed only to the proximate lower end of said inner sleeve and having its proximate upper end affixed only to said offshore structure at said second point.

5. The compliant pile system of claims 1, 3 or 4 including:

a plurality of aligned, vertically spaced guides means affixed to said offshore structure at points intermediate the ends of said pile jacket, said pile jacket passing through said guides and having relative axial movement with respect thereto.

6. The compliant pile system of claim 1 wherein said pile system comprises a plurality of spaced pile elements.

7. A compliant pile system for supporting the vertical weight of a guyed tower structure of the type having a main truss member which extends between a marine bottom and the surface of a body of water and a plurality of guylines extending between said main truss member and said marine bottom to maintain said truss member in a vertical position, said pile system comprising:

at least one pile element comprising:

a pile jacket extending from the lower end of said main truss member to a point below the wave zone of said body of water, said pile jacket being affixed to only one point on said main truss member; and a pile member positioned within said pile jacket and extending from the top of said pile jacket to a point within said marine bottom, said pile member being affixed to said pile jacket only at the upper end of said pile member.

8. A compliant pile system for supporting the vertical weight of a guyed tower structure of the type having a main truss member which extends between a marine bottom and the surface of a body of water and a plurality of guylines extending between said main truss member and said marine bottom to maintain said truss member in a vertical position, said pile system comprising:

at least one pile element comprising:

a pile jacket, having an upper and lower end, extending from a first point of said main truss member to a second point on said main truss member, said second point being above said first point, said pile jacket affixed to said main truss structure only at the lower end of said pile jacket; and a pile member positioned through said pile jacket and extending from the upper end of said pile jacket to a point within said marine bottom, said pile member being affixed to the proximate upper end of said pile jacket at only the upper end of said pile member.

9. The compliant pile system for a guyed tower structure of claims 7 or 8 including:

a plurality of aligned, vertically spaced guide means affixed along said main truss member at points intermediate the ends of said pile jacket, said pile jacket passing through said guides and having relative axial movement with respect thereto.

10. The compliant pile system for a guyed tower structure of claims 7 or 8 wherein said pile system comprises a plurality of pile elements laterally spaced within said main truss member.

11. A compliant pile system for supporting the vertical weight of a guyed tower structure of the type having a main truss member which extends between a marine bottom and the surface of a body of water and a plurality of guylines extending between said main truss member and said marine bottom to maintain said truss structure in a vertical position, said pile system comprising:

at least one pile element comprising:

(a) a pile jacket extending from a first point of said main truss structure to a second point on said main truss, said second point being above said first point; said pile jacket comprising:

an outer sleeve, having an upper and lower end, affixed at its upper end to said second point on said main truss, and an inner sleeve, having an upper and lower end, concentrically positioned within said outer sleeve, said inner and outer sleeves being affixed to each other at their proximate lower ends; and (b) a pile member positioned through said inner sleeve of said pile jacket and extending from the top of said pile jacket to within said marine bottom, said pile member being affixed to said inner sleeve only at the proximate upper end of said inner sleeve.

12. The compliant pile system for a guyed tower structure of claims 8 or 11 wherein said second point being below the wave zone of said body of water.

13. The compliant pile system for a guyed tower structure of claim 11 including:

a plurality of aligned, vertically spaced guide means affixed along said main truss member at points intermediate the ends of said pile jacket, said pile jacket passing through said guides and having relative axial movement with respect thereto.

14. The compliant pile system for a guyed tower structure of claims 11 or 13 wherein said system comprises a plurality of pile elements laterally spaced within said main truss member.

* * * * *